United States Patent [19]

Fraley et al.

[11] Patent Number: 4,545,000

[45] Date of Patent: Oct. 1, 1985

[54] PROJECTION LAMP UNIT

[75] Inventors: Lawrence R. Fraley, W. Boxford, Mass.; Arnold E. Westlund, Jr., Winchester, Ky.

[73] Assignee: GTE Products Corporation, Stamford, Conn.

[21] Appl. No.: 715,584

[22] Filed: Mar. 25, 1985

Related U.S. Application Data

[63] Continuation of Ser. No. 538,721, Oct. 3, 1983, abandoned.

[51] Int. Cl.[4] ..... F21V 7/00

[52] U.S. Cl. ..... 362/304; 362/297; 362/346; 362/348

[58] Field of Search ..... 362/263, 297, 346, 348, 362/349, 350, 304

[56] References Cited

U.S. PATENT DOCUMENTS

| | | | |
|---|---|---|---|
| 3,944,810 | 3/1976 | Grindle | 362/297 |
| 4,021,659 | 5/1977 | Wiley | 362/346 |
| 4,120,579 | 10/1978 | Maiorano | 355/11 |
| 4,239,369 | 12/1980 | English | 362/297 |
| 4,308,573 | 12/1981 | McNamara | 362/297 |
| 4,403,276 | 9/1983 | Blaisdell | 362/263 |
| 4,428,038 | 1/1984 | Rakitsch | 362/346 |

*Primary Examiner*—Donald P. Walsh
*Attorney, Agent, or Firm*—Lawrence R. Fraley

[57] ABSTRACT

An improved projection lamp unit including a glass reflector having a concave reflecting surface and a tungsten halogen lamp positioned within the concavity of the reflector. The concave reflecting surface of the reflector is provided with alternately disposed radially extending regions including a series of specular stripes in combination with alternately spaced regions of facets. Preferably four or five stripes and an associated four or five facet regions are provided.

9 Claims, 3 Drawing Figures

PROJECTION LAMP UNIT

This application is a continuation of application Ser. No. 538,721, filed Oct. 3, 1983, abandoned.

TECHNICAL FIELD

The invention relates to incandescent lamp and glass reflector combinations, particularly for use in projection systems such as 16 mm. movie and slide projectors. The invention has particular application in an overhead projector system.

BACKGROUND

A projection lamp unit which forms part of a projection system such as mentioned above generally includes a preformed glass reflector and projection lamp (e.g. tungsten halogen). The reflector generally has an elliptical surface of revolution with the lamp filament at or near the focal point for concentrating a beam of light through the system's various elements (e.g. film gate and associated lens). Examples of such lamp units are found in U.S. Pat. Nos. 3,789,212 and 3,761,170. In some units, the reflector surface is smooth and highly polished (specular) so as to maximize the controlled energy directed through the system. The aforementioned U.S. Pat. Nos. 3,761,170 and 4,392,189 illustrate such a smooth surfaced reflector.

Although the smooth and highly polished reflector provides substantially maximum optical output, the resulting beam pattern often tends to be non-uniform, creating what are termed "hot spots" and thus resulting in degraded resolution of the projected image. In view of such non-uniformity of the beam pattern, many present designs utilize a reflector surface that is completely diffuse (e.g., containing peens or facets). In this regard, see U.S. Pat. Nos. 3,825,742, 4,035,631 and 4,021,659, as well as British patent application No. 2,085,745A. U.S. Pat. No. 4,021,659 in particular illustrates an all-faceted projection lamp unit reflector presently employed in some commercial projecting units.

Although the totally faceted reflector improves the uniformity of the beam pattern in comparison to all-specular surfaced reflectors, there tends to be a significant light loss using such a surface.

DISCLOSURE OF THE INVENTION

It is, therefore, an object of the present invention to provide an improved projection lamp unit including a reflector in which optical energy output and beam pattern uniformity are optimized. In particular, the reflector of this invention, in comparison with an all-faceted reflector, provides improved total optical output and smaller corner-to-corner differential, which in turn implies improved light distribution at the edge of the beam pattern on the screen receiving the image.

In accordance with one aspect of the invention, there is provided a reflector and lamp combination comprising a reflector having a concave (e.g., ellipsoidal) reflecting surface and a lamp (e.g. tungsten halogen) positioned within the cavity of the reflector. The reflecting surface is demarcated into alternately disposed radially extending regions. These surface regions include a plurality (e.g., four or five) of specular stripes in combination with spaced regions of facets. The combination of stripes and faceted regions provides for optimization of total optical output and beam pattern uniformity. With particular comparison to the output of an all-faceted reflector, there has been found to be both enhanced total light output in addition to smaller corner-to-corner differential, thereby resulting in better illumination of the subject screen.

BEST MODE FOR CARRYING OUT THE INVENTION

For a better understanding of the present invention together with other and further objects, advantages and capabilities thereof, reference is made to the following disclosure and appended claims in connection with the above described drawings.

Figure 1:
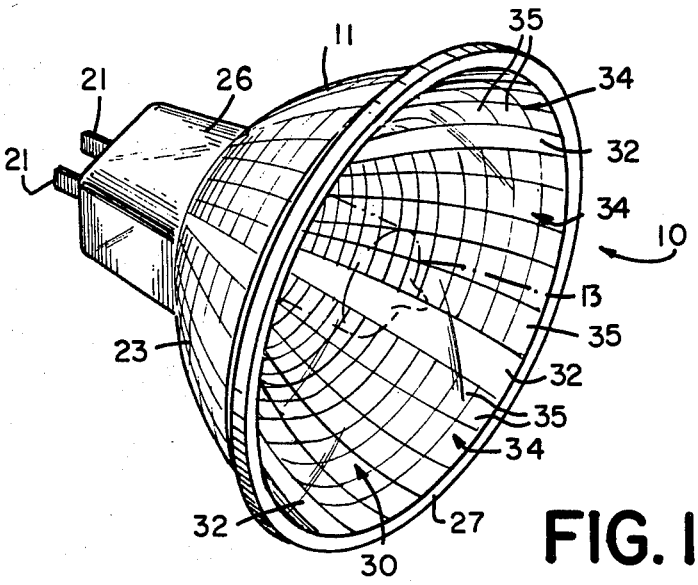
FIG. 1 is a perspective view of a projection lamp unit in accordance with a preferred embodiment of the present invention.

With reference to the drawings, there is illustrated a projection lamp unit 10 in accordance with a preferred embodiment of the present invention. Unit 10 is particularly adapted for use within a projection system such as a slide or 16 mm. movie projector. Accordingly, projection lamp unit 10 would be located within a suitable socket/holder assembly (not shown) such as described and shown in the aforementioned U.S. Pat. Nos. 3,789,212 or 3,761,170. Unit 10 includes a pressed (molded) glass reflector 11 and an incandescent projection lamp 13 (in phantom in FIGS. 1 and 2) adapted to be located within reflector 11 such as is clearly illustrated in FIG. 3. The projection lamp 13 is preferably of the tungsten/halogen type (such as one listed under ANSI code ELH) and produced and sold by the assignee of the present invention. This particular lamp produces 300 watts, is operable at normal line voltages, and possesses an average life of 35 hours. The envelope portion 15 of lamp 13 preferably includes a CC8 (coiled coil) tungsten filament 17 (FIG. 3) which is electrically connected within the lamp's press sealed end 19 (adjacent to envelope 15) to a pair of contact pins 21 which project from the lamp envelope. Filament 17 also may include a parallel (to the coil) support wire 24 which assists in maintaining (supporting) the coiled portion of the filament in the position shown within the lamp's envelope. FIG. 3 also illustrates the molybdenum foil strips 22 which conductively interconnect the filament 17 with the contact pins 21. The lamp 13 is activated when pins 21 are connected to a suitable socket component (not shown) and the corresponding projection system placed in operation.

As indicated previously, the preferred filament used in the projection unit 10 is filament type CC8. However, the projection unit may also employ other types of lamps described hereinafter, some of which may utilize the filament type CC6. Basically, the coiled coil portion 24' of the CC8 filament structure extends along the optical axis (OA—OA) of the reflector while the coiled coil portion of a TYPE CC6 filament structure extends perpendicular to the optical axis of the reflector. Both coiled coil portions are preferably located (centered) at the reflector's focal point to assure optimum output.

Other lamps suitable for use in the projecting unit 10 include those listed under ANSI codes ENH and EHX, said lamps also produced and sole by the assignee of the present invention. ENH lamps operate at normal line voltages and are capable of producing 250 watts over an average life of 175 hours. ENX lamps typically produce 360 watts, operate at 82 volts, and are rated as having an average life of 75 hours. Both ENH and ENX type lamps utilize a CC8 filament structure. Still other lamps for use in unit 10 include those producing from about 80 to 150 watts and operable at the relatively low voltage ranges of between about 10 and about 24 volts (sometimes even lower). Lamps of this type typically use C6 or CC6 filaments and have an average operating life of between 25 and 1000 hours. These latter defined lamps are listed under such ANSI code designations as EJA, EMJ, EJN, EJL, DED and ELC. The contact pins 21 typically employed in tungsten halogen lamps of the variety described above are of molybdenum or similar conductive material. Lamp 13 is retained in position in reflector 11 using a suitable cement 25 (e.g., Sauereisan) known in the industry.

The reflector 11 is preferably made of hardglass (e.g., boro-silicate), and includes a forward (or front) concave reflecting portion 23 and a hollow rear neck portion 26 adjacent thereto. The reflecting portion 23 is depicted in the drawing as having a peripheral rim portion 27. Reflecting portion 23 is preferably elliptical or parabolic in configuration and has a concave reflecting surface 30 that is formed with alternately disposed radially extending regions including a plurality of spaced, specular stripes 32 which are disposed in the starlike pattern illustrated clearly in FIG. 2. The smooth, mirrorlike specular stripes 32 have defined therebetween spaced regions 34 each containing several diffusing facets 35. As stated, the specular stripes 32 are smooth and highly polished. The facets 35 of each region may be in the form illustrated in the aforementioned U.S. Pat. No. 4,021,659. Accordingly, each facet 35 may be substantially flat or be curved convexly.

Figure 2:
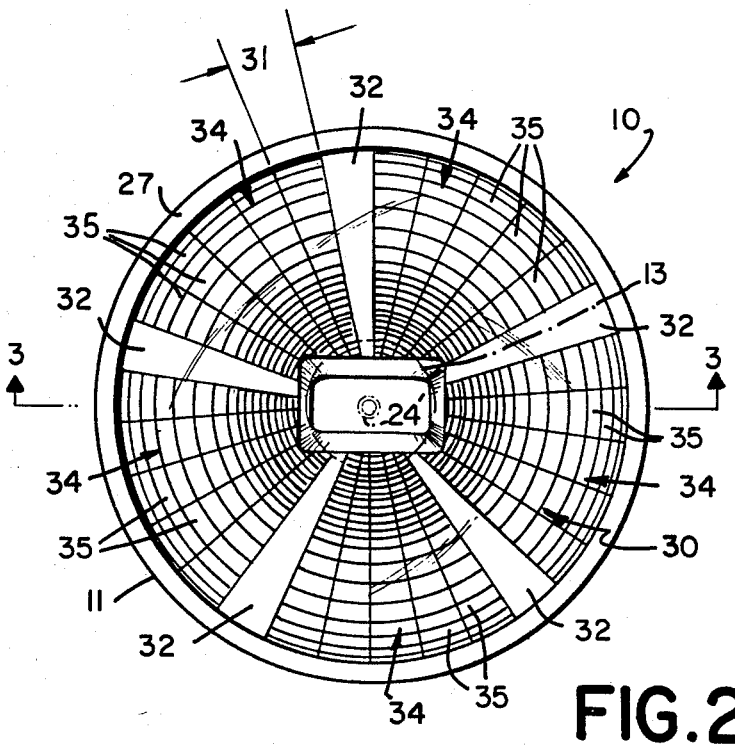
FIG. 2 is a front view of the projection lamp unit of FIG. 1.
Figure 3:
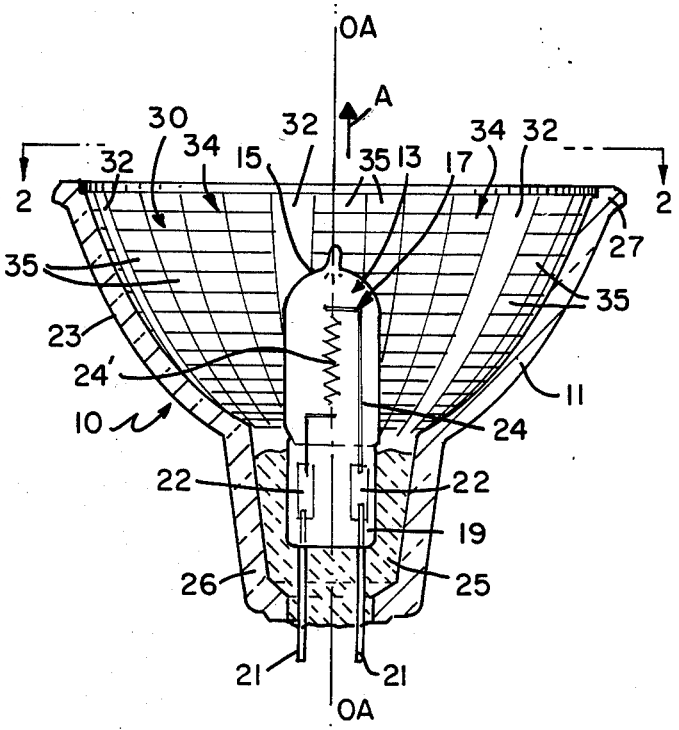
FIG. 3 is a side view, in section, of the invention as taken along line 3—3 of FIG. 2.

As indicated in FIG. 2, a total of five spaced radial stripes 32 is employed, in combination with a similar number of faceted regions 34. Preferably, the width of each specular stripe 32 is similar to the width of each radial row 31 of facets (a total of five such rows occupying each facet region 34). The preferred number of facets in each region is between about fifty and eighty, and, as illustrated, the facet sizes in each radial row, being tapered, are progressively larger as they approach the forwardmost edge (facing the viewer in FIG. 2) of the glass reflector. Widthwise in degrees, each specular stripe 32 occupies about twelve degrees, as does each radial row 31 of facets 35. The internal diameter of the reflector's front opening, in one example of the invention, was about 1.68 inch. Accordingly, the width of each row 31 and stripe 32 at this edge was about 0.176 inch. The concave reflecting surface 30 of reflecting portion 23 may be provided with a dichroic mirror coating (not shown) on its interior surface to permit much of the heat generated by lamp 13 to pass therethrough while still reflecting the lamp's visible light output in a forward direction A. Such coatings are known in the art and typically can withstand temperatures of 500° Celsius with no resultant shift in characteristics.

Comparative tests have also been conducted to compare the projector lamp reflector of the present invention with an all-faceted reflector such as depicted in U.S. Pat. No. 4,021,659. Lamps subjected to such photometric testing were those listed under ANSI code ENX. At least 20 lamps of each type were tested, each having the described CC8 filament structure. White screen appearance tests were also conducted. The photometric tests in particular measured the projected percent of light reaching the corners of the screen surface and also the total light illuminating the screen surace. The following results were attained:

| | AVG. TOTAL LIGHT (LUMENS) | AVERAGE PERCENTAGE OF LIGHT TO CORNERS | | | | AVERAGE DIFFERENTIAL |
|---|---|---|---|---|---|---|
| | | UL | LL | UR | LR | |
| Invention | 691 | 49 | 48 | 48 | 46 | 4.5 |
| All-Faceted Reflector | 685 | 48 | 49 | 51 | 52 | 6.9 |

It is understood that by UL is meant the percentage of light measured at the upper left of the screen, LL means lower left, etc. By the term average differential is meant the average of the maximum difference in corner percentage (worst case scenario) for each unit. For example, if the maximum percentage difference between any two corners in one unit was 4.0, this unit would be assigned said value. A low value, as indicated here, is deemed extremely significant and highly desired in the industry to assure output uniformity. All such readings were performed using photometric test kits known in the art. Surprisingly, these results were possible without specific placement of the CC8 filament structure relative to the stripe/facet locations. That is, these positive results were attained regardless of location of the filament's coil (24') and support wire (24) relative to the stripe/facet orientation.

From the above readings, it is seen that the total light output of the reflector of the present invention is greater than that of an all-faceted reflector such as depicted in U.S. Pat. No. 4,021,659, the corner percentage averages for both groups are substantially the same, despite use of the invention's unique specular stripes, and the average corner differential of the reflector of the present invention is substantially smaller than that of the compared all-faceted reflector. This value implies sound, even light distribution at the edge portion of the beam pattern on the distant screen.

A 3M model 213 overhead projector was used to perform the white screen test. This test was made on a comparison basis between the reflector of the present invention and the above referenced all-faceted reflector. There was no perceivably observed difference in appearance of light pattern between the different lamps. The photometric display indicated that the lamps of both types clearly satisfied industry specifications. However, the lamp of the present invention possessed highly desired greater brightness, as indicated above.

While there has been shown and described what are at present considered the preferred embodiments of the invention, it will be obvious to those skilled in the art that various changes and modifications may be made therein without departing from the scope of the invention as defined by the appended claims. For example, although five specular stripes and associated facet regions have been illustrated, it is understood that a fewer or greater number of stripes (and facet regions) may be employed. It is preferred, however to have on the order of four or five separate stripes and facet regions, with the number of each (whether four or five) being the same. In addition, it is also possible to utilize specular stripes of proportionally greater width than depicted in the drawings. For example, a total of five stripes could still be utilized, but each stripe could occupy about 24 degrees (approximately twice the width described above). Understandably, the corresponding number of radial rows of facets in each region would be reduced.

What is claimed is:

1. In a projection lamp unit including a glass reflector having a concave reflecting surface and an incandescent lamp positioned within said glass reflector and having an envelope located within the concavity of said reflector and including a coiled filament positioned within said envelope and substantiallly centered at the focal point of said reflector, the improvement wherein said concave reflecting suface comprises a plurality of alternately disposed, radially extending surface regions each including a plurality of individual diffusing facets occupying a plurality of radial rows each of a substantially tapered configuration having a maximum width at the periphery of said reflector, said surface regions of diffusing facets alternating respectively with a plurality of substantially equally spaced specular stripes each having a highly polished, mirrorlike finish and also being of a substantially tapered configuration having a maximum width at said periphery of said reflector, the combination of said regions of said diffusing facets and said specular stripes providing optimization of total optical output and beam pattern uniformity regardless of the placement of said coiled filament structure relative to the orientation of said regions of said facets and said stripes.

2. The improvement according to claim 1 wherein said lamp is a tungsten halogen lamp and said coiled filament structure is a tungsten filament structure.

3. The improvement according to claim 2 wherein said tungsten filament structure comprises a coiled coil tungsten filament extending along the optical axis of the reflector and a substantially parallel support wire adjacent said coiled coil filament and spaced therefrom.

4. The improvement according to claim 2 wherein said tungsten filament structure comprises a coiled coil tungsten filament which lies perpendicular to the optical axis of the reflector.

5. The improvement according to claim 1 wherein the width of each of said specular stripes is substantially similar to the width of each of said radial rows of said facets.

6. The combination according to claim 1 wherein the number of said regions of facets and said specular stripes is the same.

7. The combination according to claim 6 wherein said number is on the order of four or five.

8. The combination according to claim 1 wherein each of said facets is curved convexly.

9. The combination according to claim 1 wherein each of said facets is substantially flat.

* * * * *